United States Patent [19]

Kakisako

[11] Patent Number: 4,980,525

[45] Date of Patent: Dec. 25, 1990

[54] LINKED CIRCUIT BREAKERS HAVING A HANDLE TIE BAR (INTERLOCKING LEVER)

[75] Inventor: Hiroyuki Kakisako, Fukuyama, Japan

[73] Assignee: Mitsubishi Denki Kabushiki Kaisha, Tokyo, Japan

[21] Appl. No.: 378,296

[22] Filed: Jul. 11, 1989

[30] Foreign Application Priority Data

Jul. 12, 1988 [JP] Japan ..... 63-92895[U]

[51] Int. Cl.[5] ..... H01H 9/20

[52] U.S. Cl. ..... 200/50 R; 200/50 C

[58] Field of Search ..... 335/11, 8, 9, 10; 200/DIG. 6, 50 R, 50 C; 16/DIG. 40

[56] References Cited

U.S. PATENT DOCUMENTS 4,166,988 9/1979 Ciarcia et al. ..... 200/50 C 4,644,144 2/1987 Strobel ..... 200/DIG. 6

4,724,411 2/1988 Matsumoto et al. ..... 200/50 A

FOREIGN PATENT DOCUMENTS 58-32529 3/1973 Japan .

*Primary Examiner*—Steven L. Stephan

*Assistant Examiner*—Nilay H. Vyas

*Attorney, Agent, or Firm*—Burns, Doane, Swecker & Mathis

[57] ABSTRACT

Linked circuit breakers linked with an interlocking lever having hollows respectively receiving each handle of each circuit breaker and having a groove to be fitted in by the connecting pin positioned between each handle are fixed side-by-side. The groove of the interlocking lever has protrusions which make the groove narrower than the diameter of the connecting pin to fix the connecting pin. Thus, the interlocking lever is mounted easily to the handles of the circuit breakers by the connecting pin which inserts through the through holes of the handles.

3 Claims, 3 Drawing Sheets

LINKED CIRCUIT BREAKERS HAVING A HANDLE TIE BAR (INTERLOCKING LEVER)

FIELD OF THE INVENTION AND RELATED ART OF THE STATEMENT

1. Field of the Invention

The present invention relates to two or more circuit breakers mutually linked with an interlocking lever so as to be switched simultaneously. More specifically, the present invention is concerned with the improvement in an interlocking lever which interlockingly controls handles of the circuit breaker at the same time. Such circuit breakers are shown in FIGS. 5 and 6.

2. Description of the Related Art

Plural circuit breakers which are side-by-side for operation by an interlocking lever at the same time are known. Such circuit breakers are shown in FIGS. 5 and 6. Such a conventional circuit breaker linked with an interlocking lever has special shape and mechanism for mounting the interlocking lever.

For example, in a conventional set of three circuit breakers which are fixed side-by-side, each handle of the circuit breakers on both sides has a non-through hole. The two holes are arranged parallel to each other. A handle of the circuit breakers at the center has a through-hole. A conventional interlocking lever has three hollows for receiving three tops of the handles, and two through-holes for joining each hollow. Thus the handles are required to be made in different shapes. The assembly of the above-mentioned conventional circuit breakers and the interlocking lever is also time consuming. The conventional interlocking lever is first mounted on the center handle, and thereafter the circuit breakers of both sides are arranged on both sides of the central circuit breaker. During the above arrangement, a connection pin is inserted in the through-hole of the interlocking lever, the through-hole of the center handle and the non-through holes of the left side handle and the right side handle. Finally, the three circuits breakers linked with the interlocking lever are fixed side-by-side by bolts.

The above-mentioned conventional multi-circuit breaker linked with the interlocking lever have the following problems:

Since the conventional interlocking lever must have the through-holes, a mold case to be used for making the interlocking lever needs a sliding mechanism to make a through-hole. Therefore, the structure of the mold case is complicated , and manufacturing costs become high. Furthermore, the handles of both end parts having the non-through holes are formed in different shapes from the central one which has a through-hole. Therefore, two shapes of handles are necessary.

OBJECT AND SUMMARY OF THE INVENTION

It is an object of the present invention to provide circuit breakers fixed side-by-side with a low-cost interlocking lever which is made of a mold case having a simple structure.

Another object of the invention is to provide circuit breakers fixed side-by-side, wherein three handles are of the same shape.

The circuit breakers linked with an interlocking lever according to these object comprises Such circuit breakers are shown in FIGS. 5 and 6. plural handles of circuit breakers fixe side-by-side each having a through-hole, a connecting pin for inserting in the through-holes of said handles.

an interlocking lever having hollows for receiving the handles, and having at least one groove that joins the hollows and that receives the connection pin.

While the novel features of the invention are set forth particularly in the appended claims, the invention, both as to organization and content, will be better understood and appreciated, along with objects and features thereof, from the following detailed description taken in conjuction with the drawings.

DESCRIPTION OF THE PREFERRED EMBODIMENT

Figure 1:
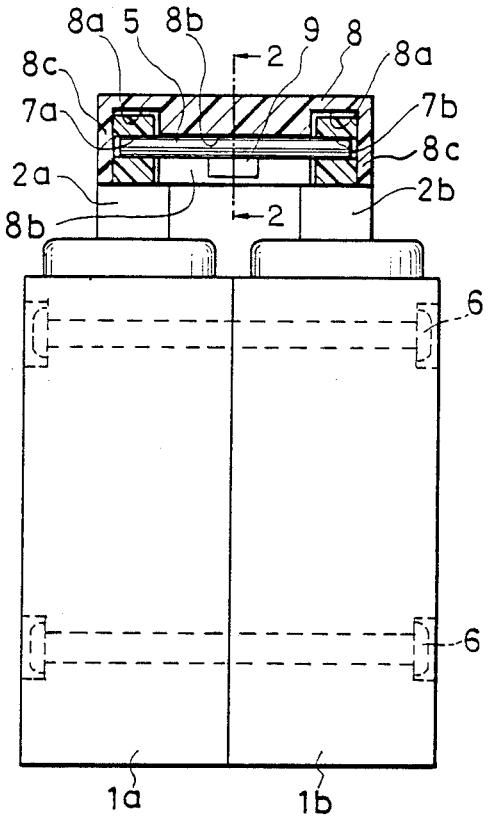
FIG. 1 is a side elevational view, partly in cross section, of a preferred embodiment of the circuit breakers with an interlocking lever in accordance with the present invention.
Figure 2:
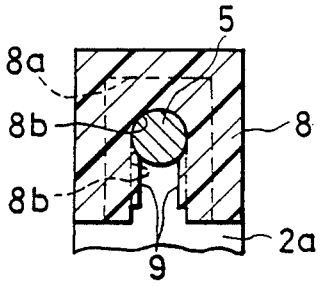
FIG. 2 is a partial sectional view taken along line 2—2 in FIG. 2.
Figure 3:
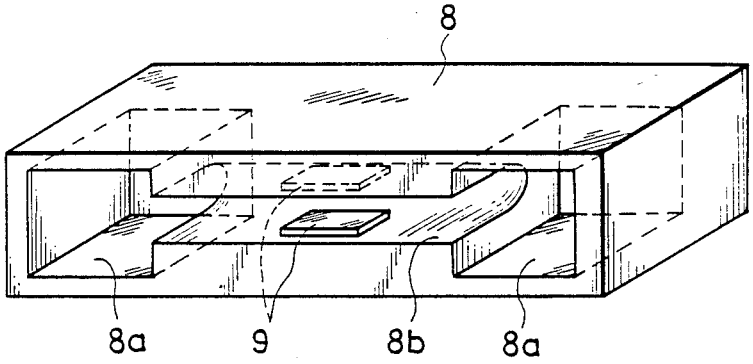
FIG. 3 is a perspective view of the interlocking lever of FIG. 1.

In the followign, circuit breakers with interlocking lever embodying the present invention is elucidated with reference to the drawings of FIG. 1, FIG. 2 and FIG. 3.

Referring to the drawings, two single-pole circuit breakers 1*a*, 1*b* are fixed side-by-side. Each handle 2*a*, 2*b* made of an insulation material, for example, ABS resin, operates each single-pole circuit breaker 1*a*, 1*b*. Each hole 7*a*, 7*b* to be inserted by a connecting pin 5 is created in each handle 2*a*, 2*b* respectively. The connecting pin 5 is made of a metal, such as hard steel wire. An interlocking lever 8 is made of an insulating material, such as ABS resin. As shown FIG. 3, the interlocking lever 8 has two hollows 8*a*, 8*a* for receiving two handles 2*a*, 2*b*, and a groove 8*b* for receiving teh connecting pin 5 which is provided linking two handles 2*a*, 2*b* by inserting its both ends in the hollows 8*a*, 8*a*. That is, the interlocking lever 8 is shaped like a box having an opening. Two protrusions 9,9 are provided near the opening of the groove 8*b*. The width of the protrusions 9,9 is narrower than the diameter of the connecting pin 5 to be fixed to a bottom of the grooove 8*b* through the protrusions 9,9 by force, as shown in FIG. 2.

The assembly of the above-mentioned circuit breakers 1*a*, 1*b* and the interlocking lever 8 in accordance with the present invention is elucidated. In the first step, two or more circuit breakers 1*a*, 1*b* are fixed side-by-side by bolts 6, 6. A connecting pin 5 is inserted in two through holes 7*a*, 7*b* of the handles 2*a*, 2*b* of the circuit breakers 1*a*, 1*b*. Next, the two tops of the handles 2*a*, 2*b* are put into the two hollows 8*a*, 8*a* of the interlocking lever 8. When the protrusions 9,9 in the interlocking lever 8 touch the connecting pin 5, the interlocking lever 8 is pressed with more force to fix the connecting pin 5. Then, passing the narrow gap between the protrusions 9,9 the connecting pin 5 is placed stably at the bottom of the groove 8*b*. In this way, the assembly of the circuit breakers 1*a*, 1*b* linked with the interlocking lever 8 in accordance with the present invention is preformer.

In the above-mentioned circuit breakers 1*a*, 1*b* linked with thhe interlocking lever 8, the interlocking lever 8 tightly fits the handles 2*a*, 2*b*. And the connecting pin 5 firmly fits the bottom of the groove 8*b* without fear of coming off. Of course, the connecting pin 5 does not came off the interlocking lever 8 after the assembly as shown in FIG. 1, since both ends of the connecting pin 5 are covered by the end walls 8*c*, 8*c* of the interlocking lever 8.

Figure 4:
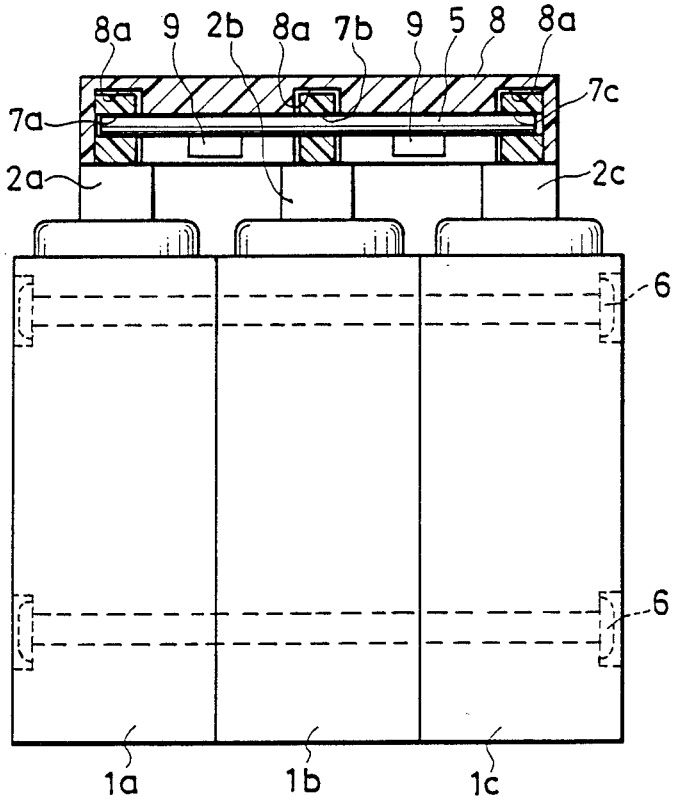
FIG. 4 is a side elevational view, partly in cross section, of another preferred embodiment of the circuit breakers with an interlocking lever in accordance with the present invention.
Figure 5:
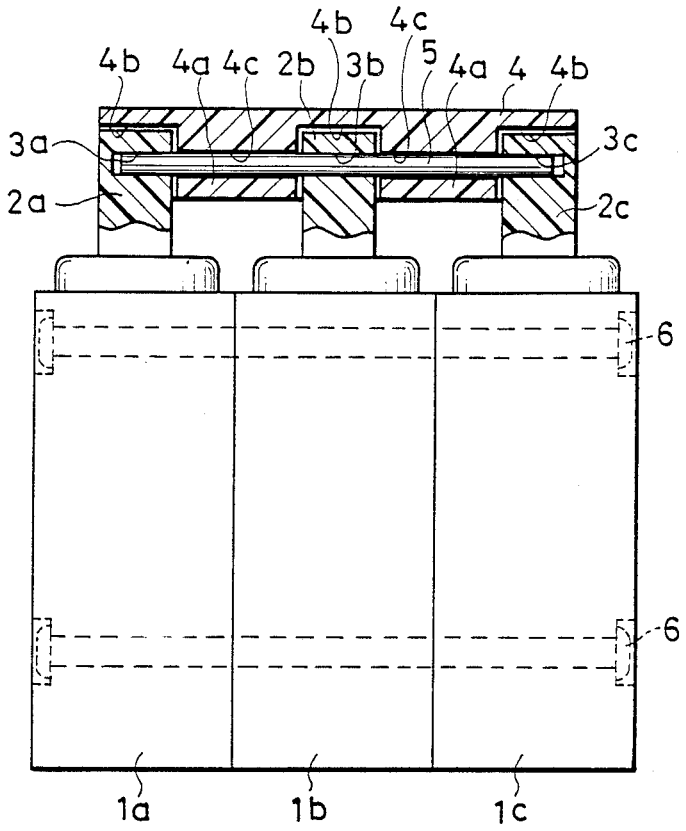
FIG.5 (Prior Art)
FIG. 5 is a side elevational view, partly in cross section, of a prior art circuit breaker.
Figure 6:
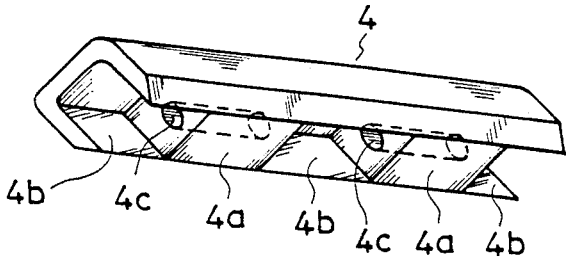
FIG.6 (Prior Art)
FIG. 6 is a perspective view of a conventional interlocking lever.

Although the above-mentioned embodiment on assemblage has been described for the set of two circuit breakdown 1*a*, 1*b* fixed side-by-side, an interlocking lever in accordance with the present inventin can be applied in three (or more) circuit breakers 1*a*, 1*b*, 1*c* as shown in FIG. 4. In this case too, three (or more) handles 2*a*, 2*b*, 2*c* are formed in the same shape as described in the above-mentioned embodiment. Thus, the technical effect of this case has the same effect of the two circuit breakers.

By the configuration in accordance with the present invention, a mold to form an interlocking lever can be made with undercut, because the mold need not have a sliding mechanism. Furthermore, since all the handles have the same shape, the liked circuit breakers can be manufactured at a lower cost assembled, and can easily.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. Linked circuit breakers linked with an interlocking lever, comprising:

circit breakers fixed to each other side-by-side, each of said circuit breakers having a handle, each of said handles having structure defining a hole, the hole of the handle of one of sid at least two circuit breakere being aligned with the hole of the handle of the other of said at least two circuit breakers;

a connecting pin inserted in said holes of said handles; and an interlocking lever which has hollows for respectively reveiving said handles and at least one groove disposed between said hollows for receiving the connecting pin, said at least one groove having protrusions arranged facing each other near the opening of the groove therebhy to keep said connecting pin in said at least one groove.

2. Linked circuit breakers in accordance with claim 1 wherein said interlocking lever is made of a resilient resin and wherein the thickness of a gap between said protrusions is such that the connecting pin is put into said groove to the bottom of said groove by widening the gap between said protrusions.

3. Linked circuit breakers linked with an interlocking lever, comprising:

circuit breakers fixed to each other side-to-side, each of said circuit breakers having a handle, each of said handles having structure defining a hole, the hole of the handle of one of said at least two circuit breakers being aligned with the hole of the handle of the other of said at least two circuit breackers;

a connceting pin inserted in said hole of said handles; and an interlocking lever which has hollows for respectively receiving said handles, at least one groove disposed between said hollows for receiving the connecting pin, and end walls at both ends of said lever for preventing said connecting pin from falling off.

* * * * *